US007155872B2

(12) United States Patent
Francom

(10) Patent No.: US 7,155,872 B2
(45) Date of Patent: Jan. 2, 2007

(54) OPEN FRAMES FOR PROVIDING STRUCTURAL SUPPORT AND RELATED METHODS

(76) Inventor: Larry R. Francom, 2145 N. Carbonville Rd., Helper, UT (US) 84526

( * ) Notice: Subject to any disclaimer, the term of this patent is extended or adjusted under 35 U.S.C. 154(b) by 0 days.

(21) Appl. No.: 10/313,438

(22) Filed: Dec. 5, 2002

(65) Prior Publication Data

US 2004/0107669 A1 Jun. 10, 2004

(51) Int. Cl.
*E04H 12/00* (2006.01)

(52) U.S. Cl. ..... 52/648.1; 52/652.1; 52/653.1; 52/693

(58) Field of Classification Search ..... 52/648.1, 52/651.01, 651.07, 651.09, 652.1, 653.1, 52/693, 694, 649.1, 649.4
See application file for complete search history.

(56) References Cited

U.S. PATENT DOCUMENTS 1,291,298 A * 1/1919 Walker ..... 52/649.1
3,298,152 A * 1/1967 Lockshaw ..... 52/649.6
3,557,500 A * 1/1971 Schmidt et al. ..... 52/69
3,559,353 A * 2/1971 Partridge ..... 52/109
3,751,869 A * 8/1973 McDonald et al. ..... 52/654.1
3,798,864 A * 3/1974 Georgii ..... 52/651.11
3,913,105 A * 10/1975 Williamson et al. ..... 52/646
4,074,477 A * 2/1978 Runyon ..... 52/86
4,557,097 A * 12/1985 Mikulas et al. ..... 52/646
4,597,239 A * 7/1986 Matz et al. ..... 52/644
4,655,022 A * 4/1987 Natori ..... 52/646
4,689,932 A * 9/1987 Zeigler ..... 52/653.1
4,722,162 A * 2/1988 Wilensky ..... 52/652.1
4,829,739 A * 5/1989 Coppa ..... 52/745.2
4,942,700 A * 7/1990 Hoberman ..... 52/81.2
5,038,532 A * 8/1991 Shahinpoor ..... 52/109
5,070,673 A * 12/1991 Weisse ..... 52/793.1
D381,097 S * 7/1997 Hing ..... D25/132
5,921,048 A * 7/1999 Francom et al. ..... 52/637

* cited by examiner

*Primary Examiner*—Peter R. Brown
(74) *Attorney, Agent, or Firm*—Kunzler & Associates

(57) ABSTRACT

Open frames are disclosed by which structural support is provided, each frame comprising an array of slender members formed into a plurality of zig zag frame elements defining apexes, where the slender members of different zig zag frame elements integrally intersect each other at non-midpoint locations. A linear member bridges between and is integrated with some or all of the asymmetrical points of intersection, in some embodiments. The apexes so formed may comprise two slender members in some cases and four in others.

31 Claims, 16 Drawing Sheets

OPEN FRAMES FOR PROVIDING STRUCTURAL SUPPORT AND RELATED METHODS

FIELD OF THE INVENTION

The present invention relates generally to unique open frames of intersecting slender elements or segments and, more particularly, to novel open frames by which structural support is provided, which frames comprise an array of slender elements combined into a plurality of zig zag frame members defining differently extending apexes where the slender members of different zig zag frame members intersect each other at non-midpoint or asymmetrical locations. A linear member may sequentially bridge between and merge with some or all of the asymmetrical points of intersection. The apexes are formed of two angularly related two slender members in some embodiments and four in others.

BACKGROUND

In the past, providing a frame or framework by which structural support is obtained has presented significant problems including, but not limited to: (1) cost effectiveness; (2) excessive weight and size; (3) excessive delectability; (4) limited strength when size is constrained; and (5) significant expandability.

Some of the problems mentioned above were addressed by the iso-truss invention of U.S. Pat. No. 5,921,048, which, unlike the present invention, discloses use of two special helixes and a reverse helix by which outwardly directed nodes or apexes are formed, among other things. Wide, basically flat, frameworks may not readily be formed using the technology of U.S. Pat. No. 5,921,048, among other things.

A need continues to exist for frames and frameworks which are cost effective, lighter in weight, smaller sized in terms of component elements, less deflectable under load, which are not, per se, dimension limiting, and can be selectively expandable.

BRIEF SUMMARY AND OBJECTS OF THE INVENTION

In brief summary, the present invention overcomes or significantly alleviate prior problems in frame and frameworks for providing structural support. In short, novel open frames are provided by which structural support is given, each of the frames comprising an array of slender elements formed or combined into a plurality of zig zag frame members defining differently extending apexes where the slender members of different zig zag frame elements angularly and integrally intersect to each other at asymmetrical non-midpoint locations. An additional linear member may bridge between and integrally merge sequentially with aligned asymmetrical points of intersection. Each apex is typically formed of two angularly related slender elements in some cases and four in others.

With the foregoing in mind, it is a primary object of the present invention to overcome or significantly alleviate prior problems in frames and framework for providing structural support.

Another valuable object is the provision of open frames by which structural support is provided, such that each frame comprises an array of slender elements combined into a plurality of zig zag frame members defining differently extending apexes where the slender elements of different zig zag frame members integrally intersect each other at asymmetrical or non-midpoint locations.

A further important object is the provision of frames of the type mentioned above further comprising an additional linear member bridging between and integrally merging with aligned points of intersection.

An additional object of significance is the provision of frames of the type characterized above wherein the apexes are formed of two angularly-related slender elements in some cases and four in others.

Another paramount object of the present invention is the provision of novel open frames which can be used alone for support or, in the alternative, be embedded in a material such as composite, resin and/or concrete.

A further desirable object is the provision of novel frames which can be expanded by repeating the pattern of the frames.

These and other objects and features of the present invention will be apparent from the detailed description taken with reference to the accompanying drawings.

DETAILED DESCRIPTION OF THE ILLUSTRATED EMBODIMENTS

Figure 1:
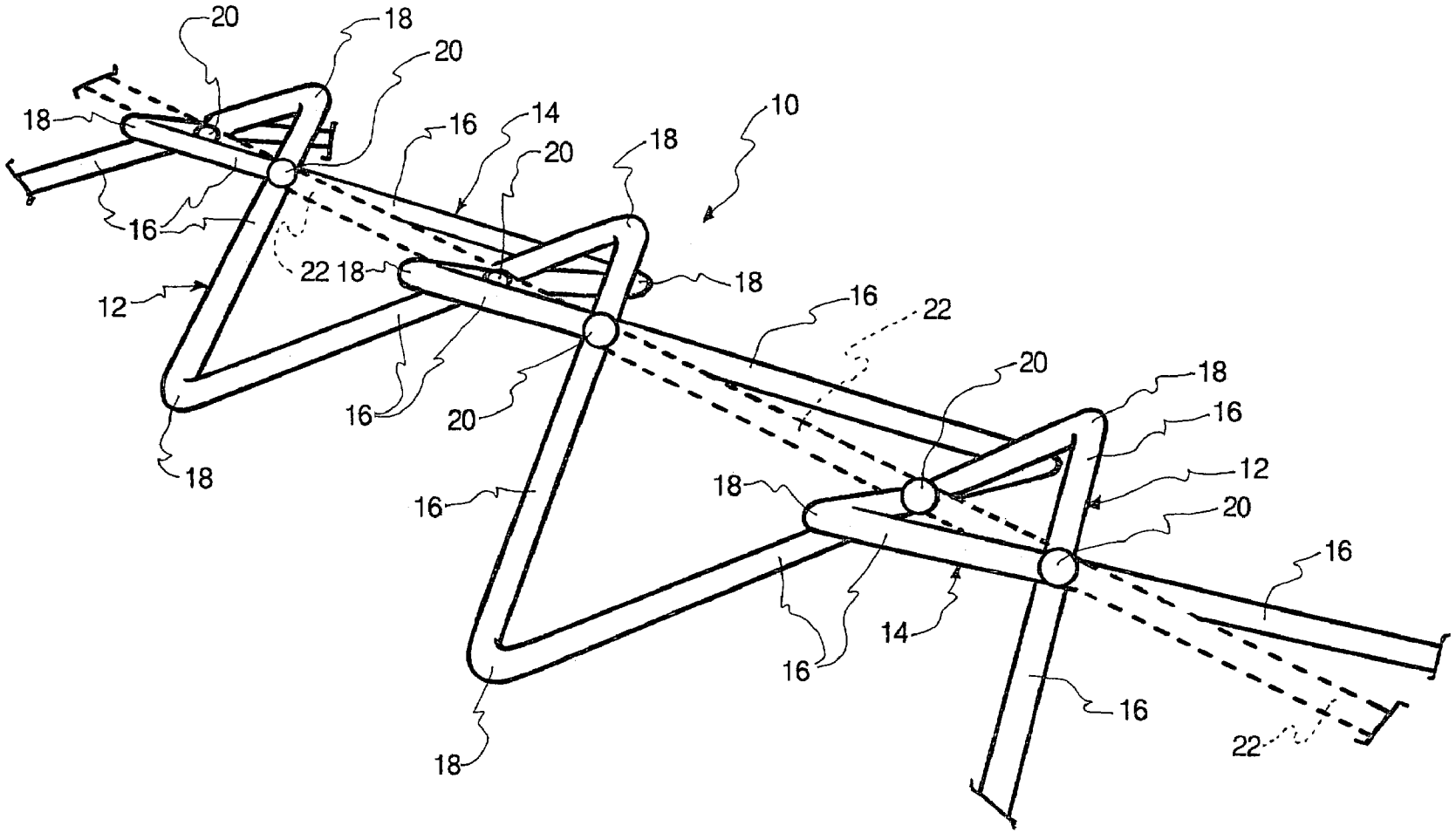
FIG. 1 is fragmentary perspective of one open frame embodiment of the present invention, which can be used as a column, a beam or a lattice, each comprised of two angularly related slender elements which provides support alone or embedded in a material, such as composite, resin and/or concrete.

Specific reference is now made to the drawings, wherein like numerals are used to designate like parts throughout. The illustrated embodiments comprise slender elements which are combined to make up zig zag members, at least two of which intersect at spaced points of intersection. The points of intersection being fully integral and rigid, each point of intersection being asymmetrically disposed along the slender elements which intersect or, in other words, the points of intersection are asymmetrical along each integrated slender member. The points of intersection are diagrammatical illustrated in the drawings by a circle, but it is to be understood to mean only that the integration of slender members occurs at the point of intersection, realizing that the intersection points may not per se be circular. Integration at each point of intersection may be accomplished, depending upon the material used, by bonding, molding or otherwise forming of the frame comprising the slender elements as a single piece. Metal or plastic welding, depending upon material used is also an option. The slender elements may comprise relatively thin metal rods or other shapes of steel, aluminum, or some other suitable metal, composite material or high strength synthetic resinous materials having high tensile, compression and flexure strength when formed into frames in accordance with the present invention and subjected to various types of loads.

The frames of the invention comprise outwardly directed apexes comprise angularly related end points of two or four slender elements. Some frame embodiments comprise apexes which are somewhat oppositely directed.

FIG. 1 illustrates a frame, generally designated 10, implementing principles in accordance with the present invention. Frame 10 is illustrated as comprising two zig zag members, generally designated 12 and 14. Each zig zag member 12 and 14 comprises slender elements 16, shown as rods. Other cross sectional shapes could be used. The rods 16 of each zig zag member 12 and 14 integrally merge at asymmetrical nodes or apexes 18. The rods 16 forming each apex 18 are illustrated as being formed as one piece.

While not mandatory, the two zig zag members 12 and 14 are illustrated as being disposed in two diagonally oriented planes which planes intersect at integral interior intersection points 20, shown as circles for diagramatic purposes. More specifically, the intersection points 20 of the two planes constitute points where two slender members 16, one from each of the two planes mentioned above, integrally intersect. The points of intersection 20 are not at the midpoint of the associated slender members 16 and are, therefore, asymmetrical, so that the apexes associated with any point of intersection 20 and extending in one direction have short dimensions and the apexes extending from the point of intersection 20 in another direction have long dimensions. As illustrated in FIG. 1, the short legged apexes 18 are illustrated as being above the associated point of intersection 20 while the long legged apexes 18 are disposed below the associated point of intersection.

The configuration of FIG. 1 is relatively lightweight, is dimensionally small compared with other types of the frames for like purposes, does not readily deflect, is cost effective and can be enlarged axially and laterally. The frame of FIG. 1 may be used as a column or as a beam. In the alternative, the pattern of FIG. 1 may be extended axially or repeated transversely in alternating inverted disposition.

To provide further rigidity, a linear structural element or member 22, shown as a rod, may be added so as to integral merge with all of the aligned points of intersection 20. By adding linear element 22, greater tensile, compressive, shear and bending strength is provided.

The structure illustrated in FIG. 1 can be expanded in an axial direction by simply extending the pattern shown and described. The pattern of FIG. 1 can be expanded laterally in one or both transverse directions by providing an additional segment of the type described and placing it in inverted relation to one side of the frame 10 shown in FIG. 1 and integrally connecting the short-legged apexes of the frame 10 to the long-legged apexes of the added segment and the long-legged apexes of frame 10 to short-legged apexes the added segment. Additional supplemental frame segments can thereafter be added in alternately inverted relation to the next adjacent frame segment to further enlarge the width of the frame shown in FIG. 1.

Figure 2A:
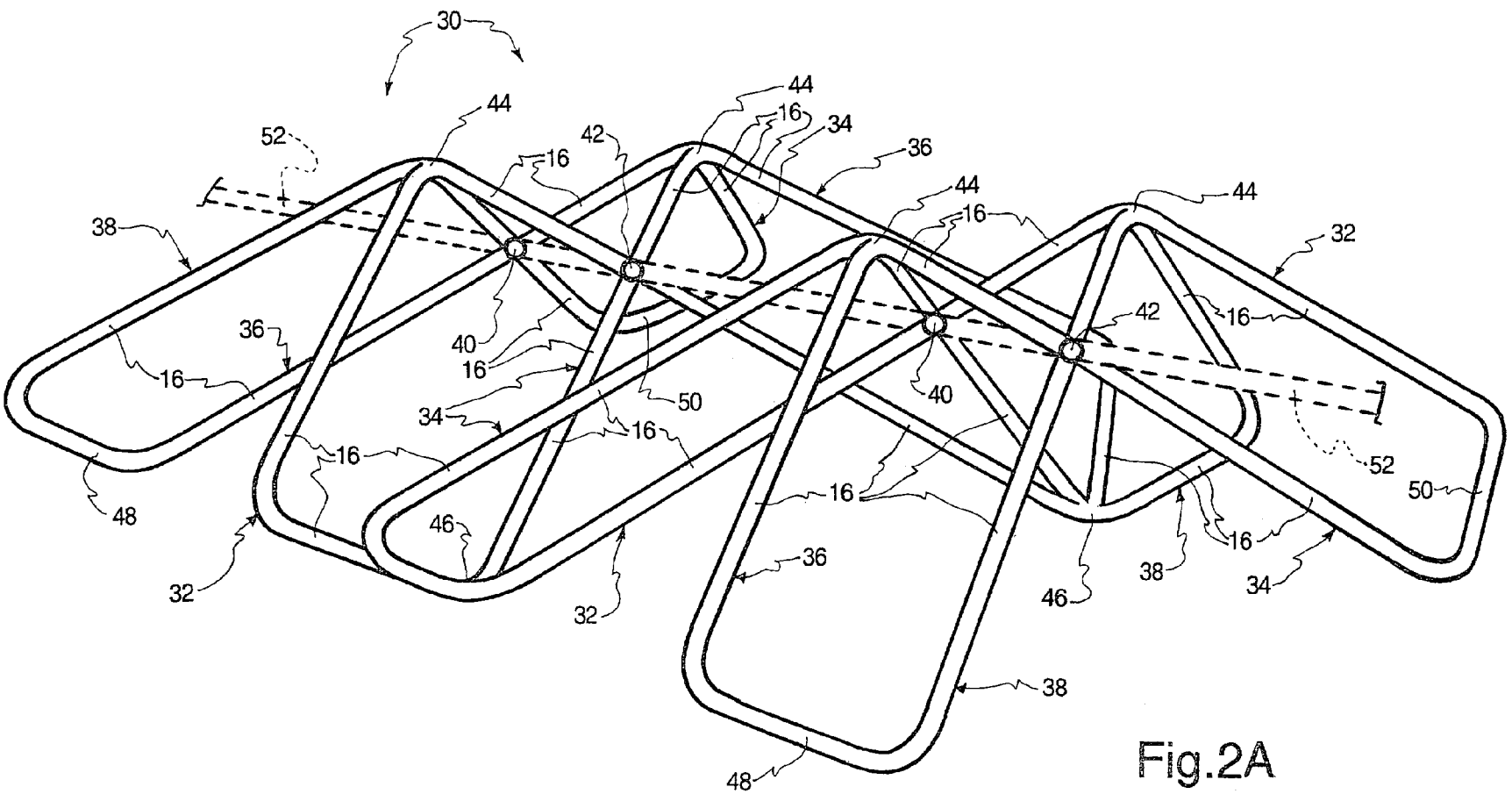
FIG. 2A is a fragmentary perspective of another open frame embodying principles of the present invention characterized by four element apexes, among other things.
Figure 2B:
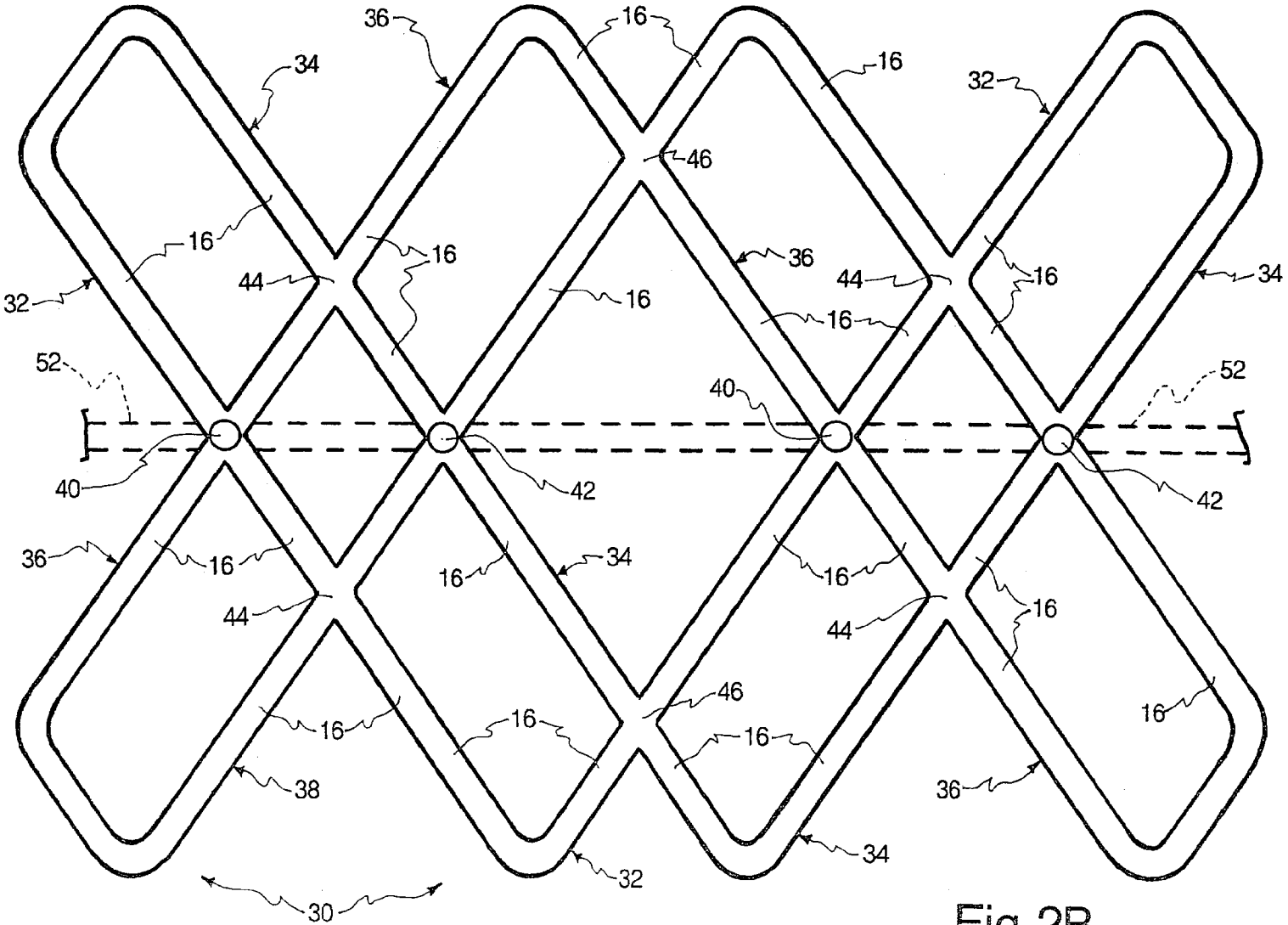
FIG. 2B is a top plan view of the open frame shown in FIG. 2A.

Reference is now made to FIG. 2A and 2B, which illustrated a further frame 30, fashioned in accordance with principles of the present invention. The frame 30 is comprised of four zig zag members, respectively, respectively generally designated 32, 34, 36 and 38. The four zig zag members 32, 34, 36 and 38 are diagonally disposed in respect to the horizontal and vertical (as illustrated in FIG. 2A). Zig zag members 32 and 34 are also diagonally disposed in respect to zig zag members 36 and 38. The four zig zag members are formed of slender elements 16, shown as linear rods. Slender element 16 of zig zag members 32 and 36 integrally intersect at points of intersection 40, while the slender elements 16 of zig zag members 34 and 38 intersect at integral points of intersection 42.

As can best be seen in FIG. 2A, the points of intersection are asymmetrical, in other words, not at the midpoint of either slender member forming the point of intersection. This results in short legged nodes or apexes 44, shown as being above the points of intersection 40 and 42, and long legged apexes 46, shown as being below the points of intersection 40 and 42. The four apexes 44 are illustrated as being disposed in a common plane and the two apexes 46 are shown as being in a second common plane, parallel to the first.

Each of the apexes 44 and 46 are in the shape of a pyramid, where the slender elements 16, integrated at the associated apex 44, 46 form the four corners or edges of the pyramid.

The distal ends of parallel slender segments 16 of zig zag members 36 and 38 are inconnected by slender cross members 48, at two locations to create rectangular components. The distal ends of slender member 16 forming zig zag members 32 and 34 are inconnected by slender cross braces 50, at two locations.

If and to the extent desired for greater strength and less flexibility, a slender linear member 52 may comprise frame 30, oriented and joined so as to merge integrally with each point of intersection 40 and 42. See the dotted line representation in FIGS. 2A and 2B.

Figures 3A, 3B:
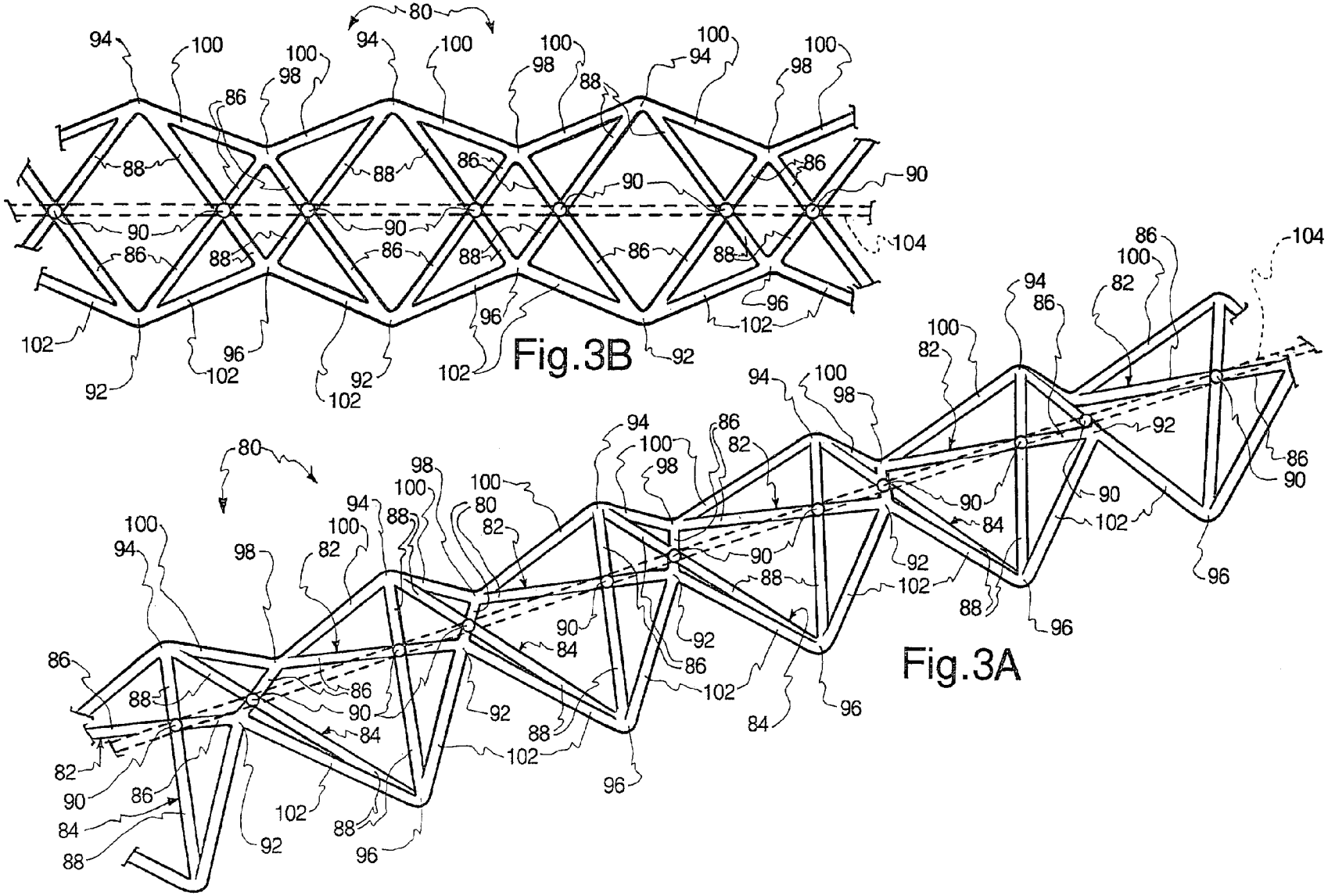
FIG. 3A is a fragmentary perspective of still another frame embodying the principles of the present invention, which is characterized by four element apexes, among other things.
FIG. 3B is a top plan view of the frame shown in FIG. 3A.

Reference is now made to FIGS. 3A and 3B which illustrate a third frame embodiment, generally designated 80 of the present invention. Zig zag frame members 82 and 84 of frame 80 are formed of slender linear segments or elements 86 and 88, respectively. Slender elements 86 and 88 integrally intersect and merge asymmetrically at the intersection points 90.

The slender elements 86 form short legged apexes or nodes 92, which are elevated above the points of intersection 90 and disposed in a common plane. Similarly, the slender elements 88 form elevated apexes 94, which are illustrated as being transversely spaced from appendixes 92, and are shown as being contained in the same plane. Similarly, slender members 88 form lower nodes or long legged apexes 96 and slender members 86 form long legged lower nodes or apexes 98. Nodes or apexes 96 and 98 are illustrated as being contained in a second plane, parallel to the first.

Apexes 94 and 98 are integrally connected by slender side members 100, while apexes 92 and 96 are integrally connected by slender side members 102.

For additional strength and rigidity, a linear, axially-directed slender support member 104 may be added so as to pass through and integrally merged with each point of intersection 90. See the dotted line representation in FIGS. 3A and 3B.

The configuration 80 in FIGS. 3A and 3B can be expanded axially by linearly extending the pattern shown in FIGS. 3A and 3B. Assembly 80 can also be expanded laterally by using one or more like frames in inverted side-by-side relation and connecting the long legged apexes of the frame 80 to the short legged apexes of the added frame and vice versa. Further, two or more of the assemblies shown in FIG. 3A and 3B may be placed in side by side relation without inversion and bolted or otherwise fastened or connected together using transversely-directed fastening structure, for example.

Figure 4:
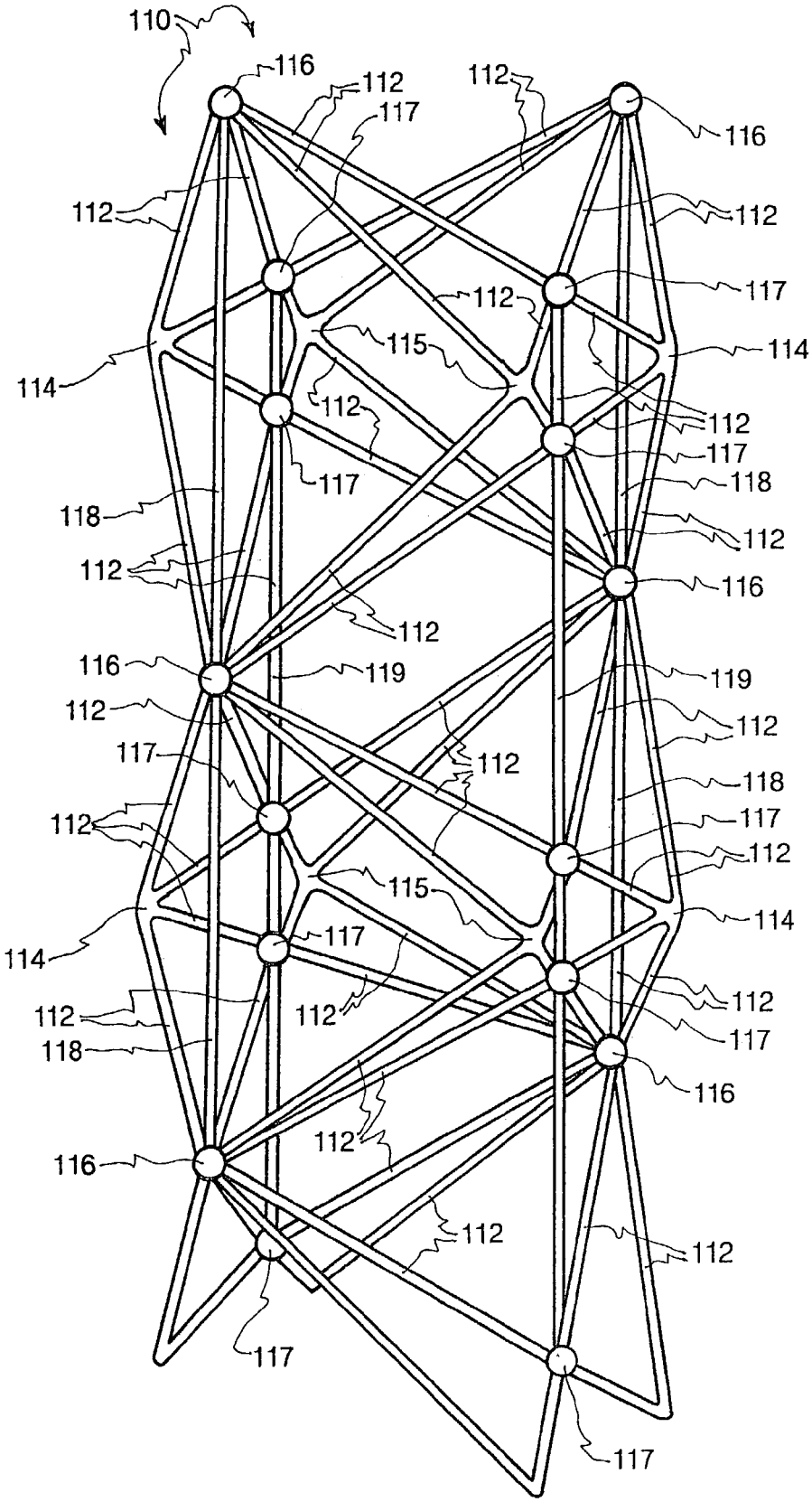
FIG. 4 is a fragmentary perspective of one more frame embodying principles of the present invention, which frame traverses 360° in cross section and may be used as a column or a beam.

Reference is now made to FIG. 4, which illustrates a wraparound frame embodiment, generally designated 110, in accordance with the principles of the present invention. The configuration of frame 110 lends itself well to utilization as a column or a beam and comprises a hollow central interior, slender elements 112, radially disposed opposed pairs of apexes 114 and 115, merged and integrated points of intersection 116 and 117 and four spaced axially directed linear members 118 and 119, which pass through and merge or integrate with the points of intersection 116 and 117, respectively.

While shown as traversing through 360°, frame 110 can be constructed so as to traverse circumferentially less than 360°, when and to the extent such is appropriate. Further, frame 110 can be utilized, as is, to support tensile, compression and shear loads or can be imbedded in a suitable material, such as composite, resin or concrete, so as to comprise internal reinforcement.

While somewhat more difficult to visualize, the slender members 112 of the frame 110 comprise a plurality of spaced zig zag members which merge at the apexes 114 and 115 and at the points of intersection 116 and 117. In essence, the frame 110 turns through a predetermined number of degrees at each point of intersection so as to cumulatively traverse (when viewed in cross section) the total number of degrees desired, which, in the case of the embodiment illustrated in FIG. 4, is 360°.

The apexes 116 and 117 extend radially outwardly from the hollow center of the frame 110 and comprise pyramids where the slender members 112 define the four corners or edges of the pyramid and form the upper tip of the pyramid.

As can be seen by inspection of FIG. 4, two of the axially directed linear slender members 119 are spaced from the center line of the frame 110 a shorter radial distance than are the other two spender linear axially directed members 118. The inner two axially members 119 pass through and integrate with points of intersection 117. The two axially members 118 pass through and integrate with intersection points 116.

Figure 5:
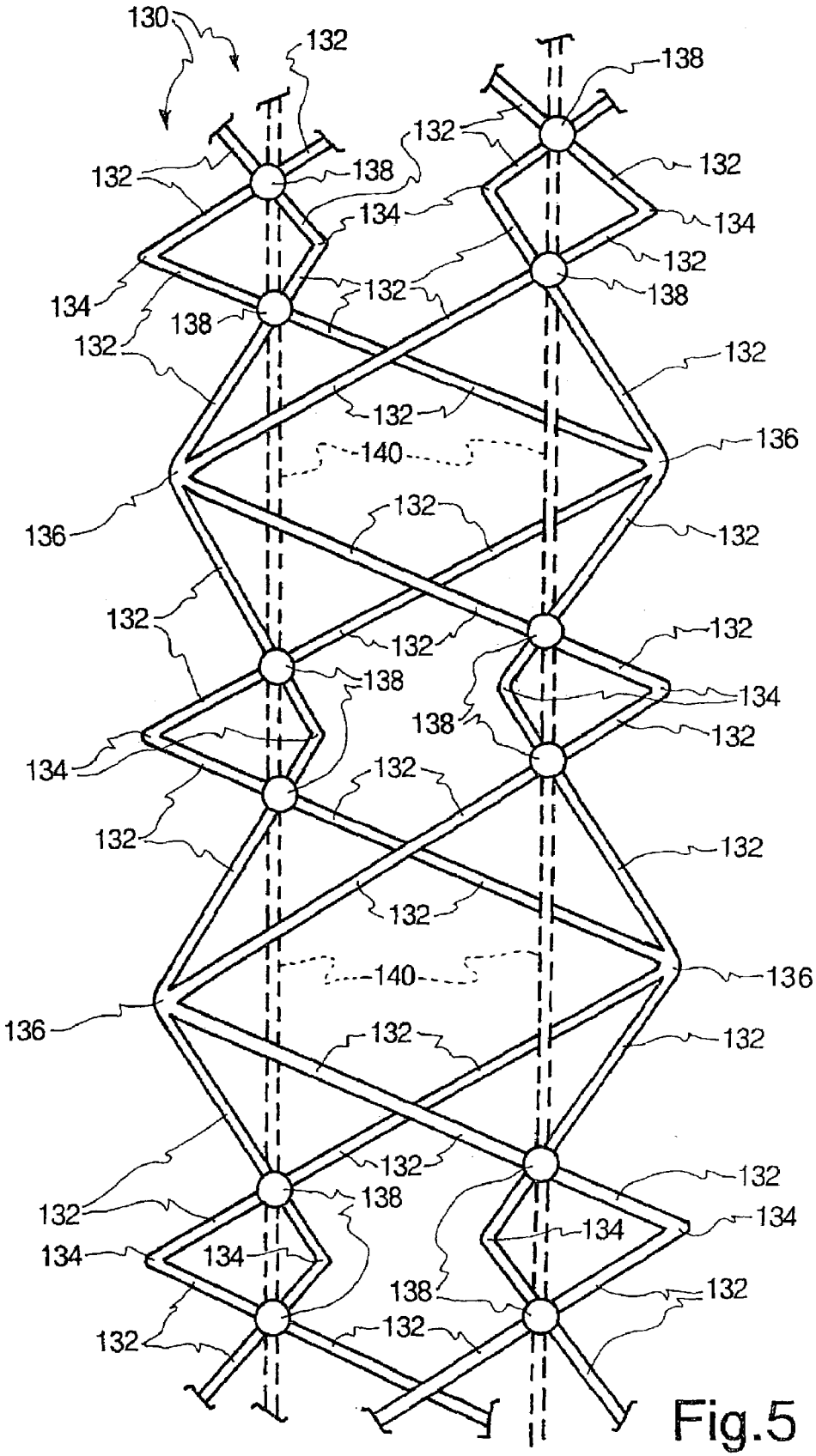
FIG. 5 is a fragmentary perspective of an additional frame embodying principles of the present invention, which frame traverses 360° in cross section and may be used as a column or a beam.

A specific reference is now made to FIG. 5 which illustrates a further embodiment of the present invention, i.e. frame 130. Frame 130 cross-sectionally circumscribes 360°, as illustrated, and is useful in providing exceptional strength particularly for column and beam applications. Frame 130 is comprised of zig zag members made up of linear slender segments or elements 132, which create short legged apexes 134 and long legged apexes 136. All of the apexes 134 and 136 extend radially outwardly from the hollow central interior of the frame 130. Apexes 134 are at a lesser radial distance and apexes 136 are at a greater radial distance. The linear slender members 132 defining the short legged and long legged apexes 134 and 136, which integrally intersect two aligned sets intersection points 138.

If greater strength and less flexibility is desired, slender linear support members 140, parallel to the center line of the frame 130, may be added in parallel relation, one to the other, so as to pass through and be integrated respectively with the two sets of aligned points of intersection 138.

Figure 6:
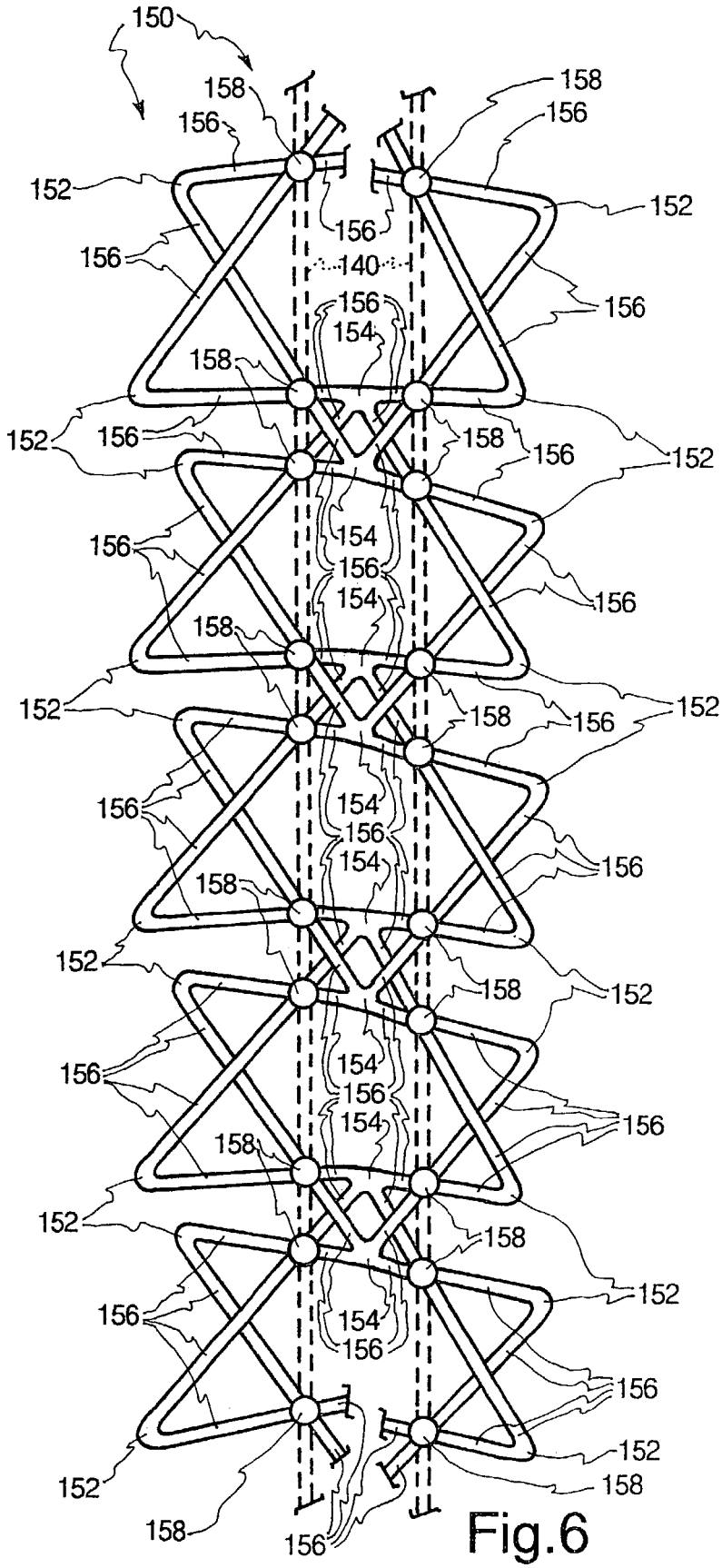
FIG. 6 is a fragmentary perspective of another frame embodying principles according to the present invention, which frame traverses 360° in cross section and may be used as a column or a beam.

A further frame embodiment, generally designated 150, is illustrated in FIG. 6, to which reference is now made. Frame 150 is similar to frame 130, described above, in that it traverses 360° circumferentially but the axially-directed linear members 140, if used, are more closely radially spaced one from the other so as to define a smaller hollow interior within the frame 150. Furthermore, while the long legged apexes of frame 130 are disposed in the shape of a pyramid, the long legged apexes 152 of frame 150 comprise two slender elements 156 forming an acute angle there between, which constitutes the associated apexes 152. Also, while the short legged apexes of frame 130 are formed by two slender linear members 132, the short legged apexes 154 of frame 150 are formed by four linear elements 156, so as to comprise a pyramid shape. The slender linear elements 156 integrally intersect at two aligned sets of points of intersection 158, through which axially directed members 140 integrally pass and merge, if used.

Figure 7:
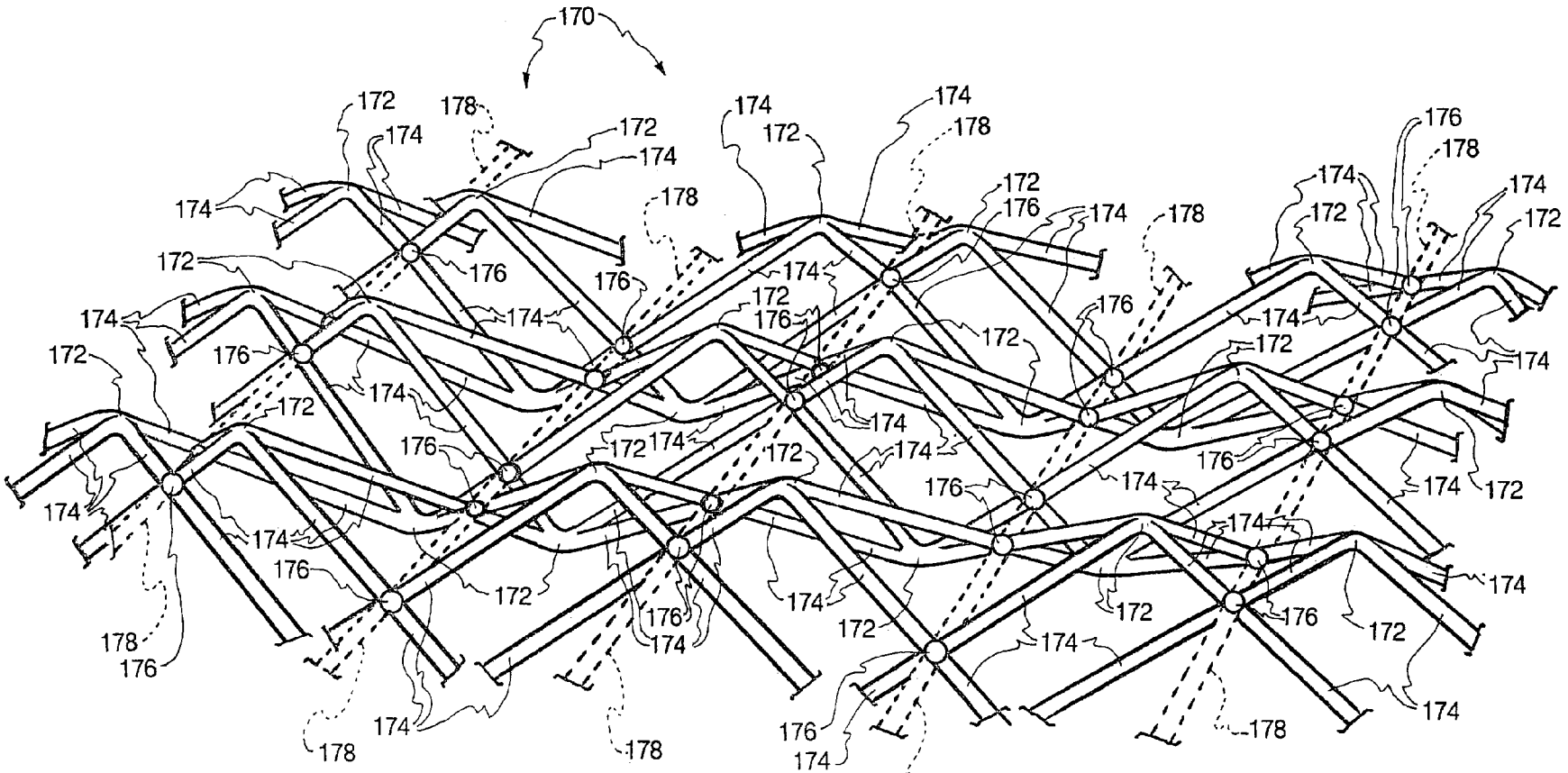
FIG. 7 is fragmentary perspective of one more frame embodying principles of the present invention, which frame has a narrow depth and by repeating and/or extending the pattern transversely and axially may be expanded as desired to provide flat panel support.

Reference is now made to FIG. 7, which illustrates a further frame embodiment of the present invention, generally designated 170. Frame or framework 170 is expandable longitudinally or axially and laterally by repeating the illustrated pattern without limitation in size. Frame 170 essentially defines a limited depth waffle-like pattern of upwardly and downwardly directed apexes 172, when viewed as shown in FIG. 7. Each of the upwardly and downwardly directed apexes 172 is formed by four linear slender elements 174 which merge at the associated apex so that each apex is pyramidic in configuration. The end result is pairs of apexes 172 directed upwardly arranged in parallel rows, when viewed either in an axially or a lateral direction. The same is true for the apexes 172 which are downwardly directed. The upwardly and downwardly directed apexes as mentioned above, form a waffle-like pattern and respectfully are contained within spaced parallel planes.

The slender elements 174 are arranged so as to form a plurality of diagonally disposed zig zag members such that the slender elements intersect each other at non-midpoint locations, or in other words, asymmetrically. These points of intersection 176 are shown diagrammatically as being circular. If desired, a plurality of parallel linear transversely directed support members 178 (shown in dotted lines in FIG. 7) may be added so as to pass through each set of aligned points of intersection 176 in integrated or merged relationship therewith. By using transverse or lateral linear support members 178, the frame 170 is strengthened and rigidified.

Figure 8:
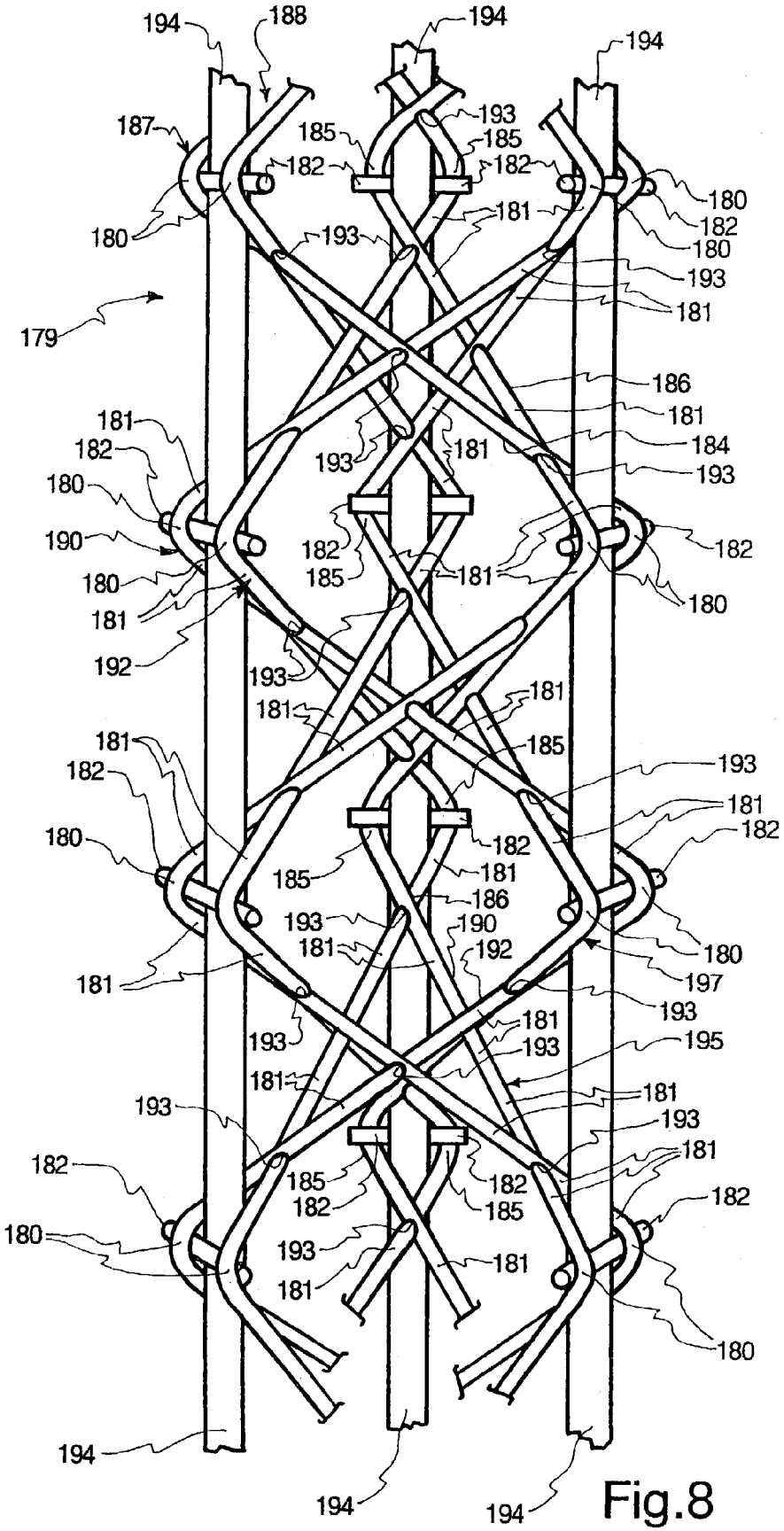
FIG. 8 is a side elevation showing another frame embodying principles of the present invention, which frame has a narrow width and by repeating and/or extending the pattern transversely and axially may be expanded as desired to provide structural support.

Reference is made to FIG. 8 which illustrates in side elevation an additional frame embodiment, generally designated 179, embodying principles of the present invention. The frame 179 is illustrated as being elongated and narrow, adequate to be utilized as either a column or a beam. However, the frame configuration of FIG. 8 can be expanded and extended by repeating the illustrated pattern to increase size and strength and to thereby provide a basis for utilization in support structures in addition to columns and beams. The frame 179 of FIG. 8 comprises six zig zag members 187, 188, 190, 192, 195 and 197. Each zig zag member 187, 188, 190, 192, 195 and 197 is disposed in a plane such that the planes and zig zag members contained therein intersect at spaced intersection points 193. The points of intersection 193 integrally unite the two members which form the intersection.

Each zig zag member 187, 188, 190, 192, 195 and 197 are comprised of outside radially extending apexes 180 and inside, are radially directed at the apexes 185. Interposed between the outside apexes 180 and the inside apexes 185 of each zig zag member are linear slender segments 181. Each zig zag member is illustrated as being formed as a single piece and comprising a rod-like cross section, although other configurations could be used within the scope of the present invention.

The frame 179 is illustrated as comprising three spaced, axially extending, peripherally disposed linear members 194, each disposed near a series of outside apexes 180. The outside linear members 194 are joined to each set of two juxtaposed apexes 180, using a short rod or stud 182 positioned as illustrated in FIG. 8.

If desired, the short rods 182 may be integrated with the associated apexes 180 and 185 using any suitable techniques, such as bonding agent or welding, depending on the material or materials used to construct frame 179.

The outside apexes 180 and the inside apexes 185 each comprise two slender elements 181 forming an acute angle therebetween.

Figure 9:
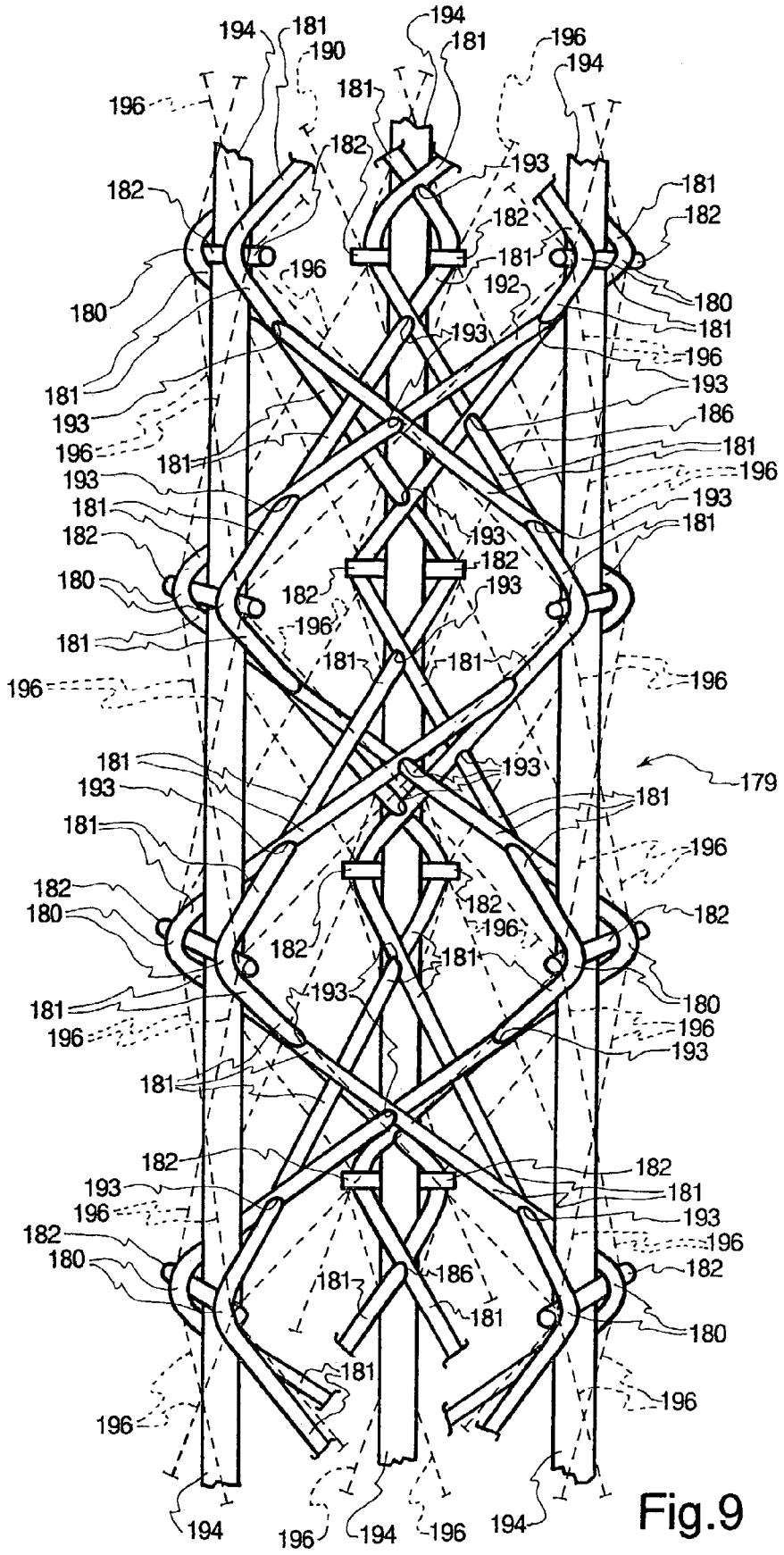
FIG. 9 is a side elevation of the frame of FIG. 8 with support being provided by additional members shown as dotted lines.

Reference is now made to FIG. 9 which illustrates a frame embodiment, generally designated 179', also embodying principles of the present invention and comprising a modification of the previously described frame 179 in that additional secondary linear segments 196 are illustrated as having been added between and integrated with apexes 180 and 185 to provide additional strength.

These additional segments 196 may be of any desired size, equal to, greater or smaller than the previously described slender segments 181. The cross sectional nature of any segment 196, while shown as a single dotted line, may be of any available type, including, but not limited to, a circular or rod-like cross section.

Figure 10:
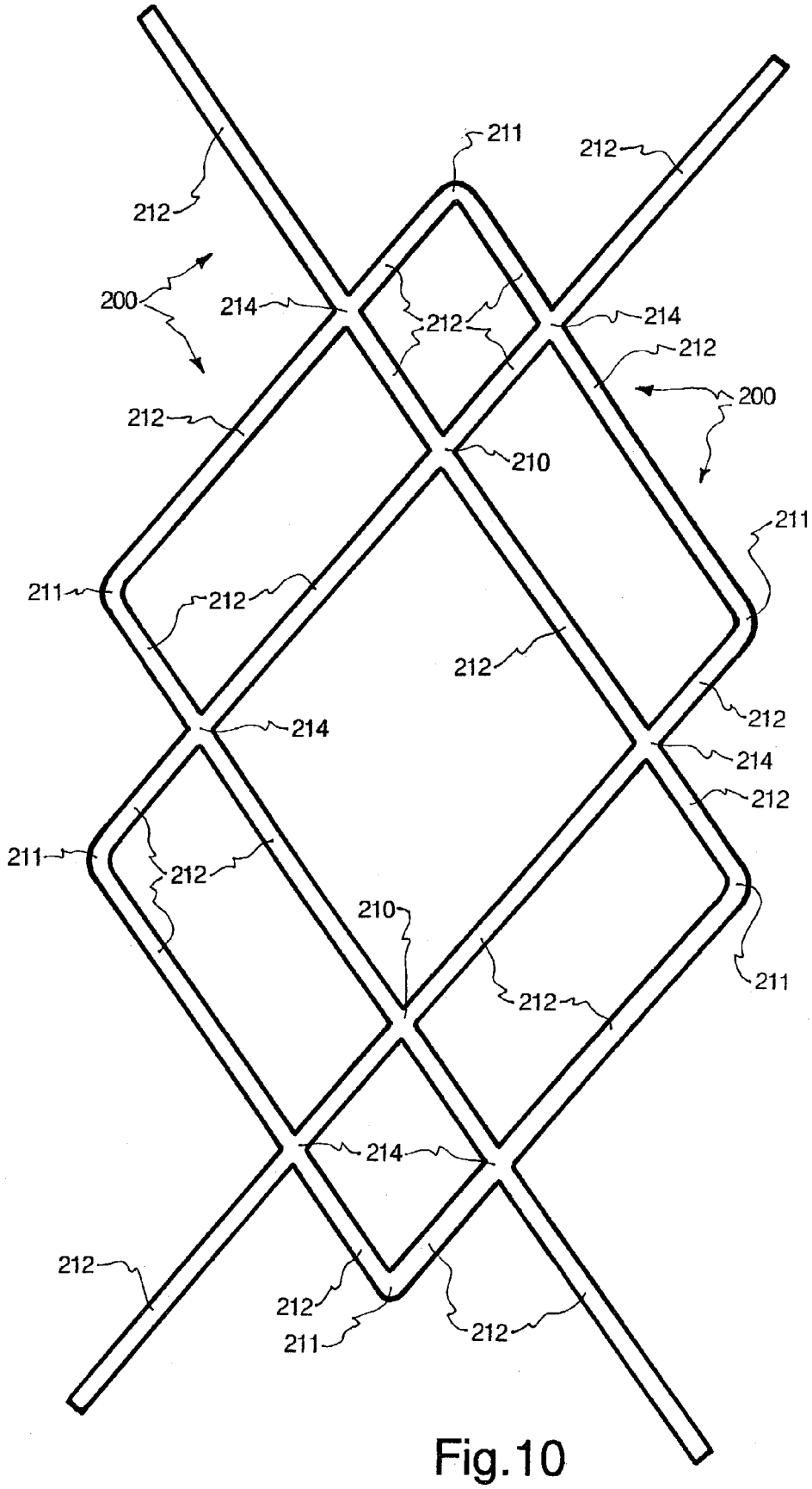
FIG. 10 is a plan view of a further frame embodiment.
Figure 11:
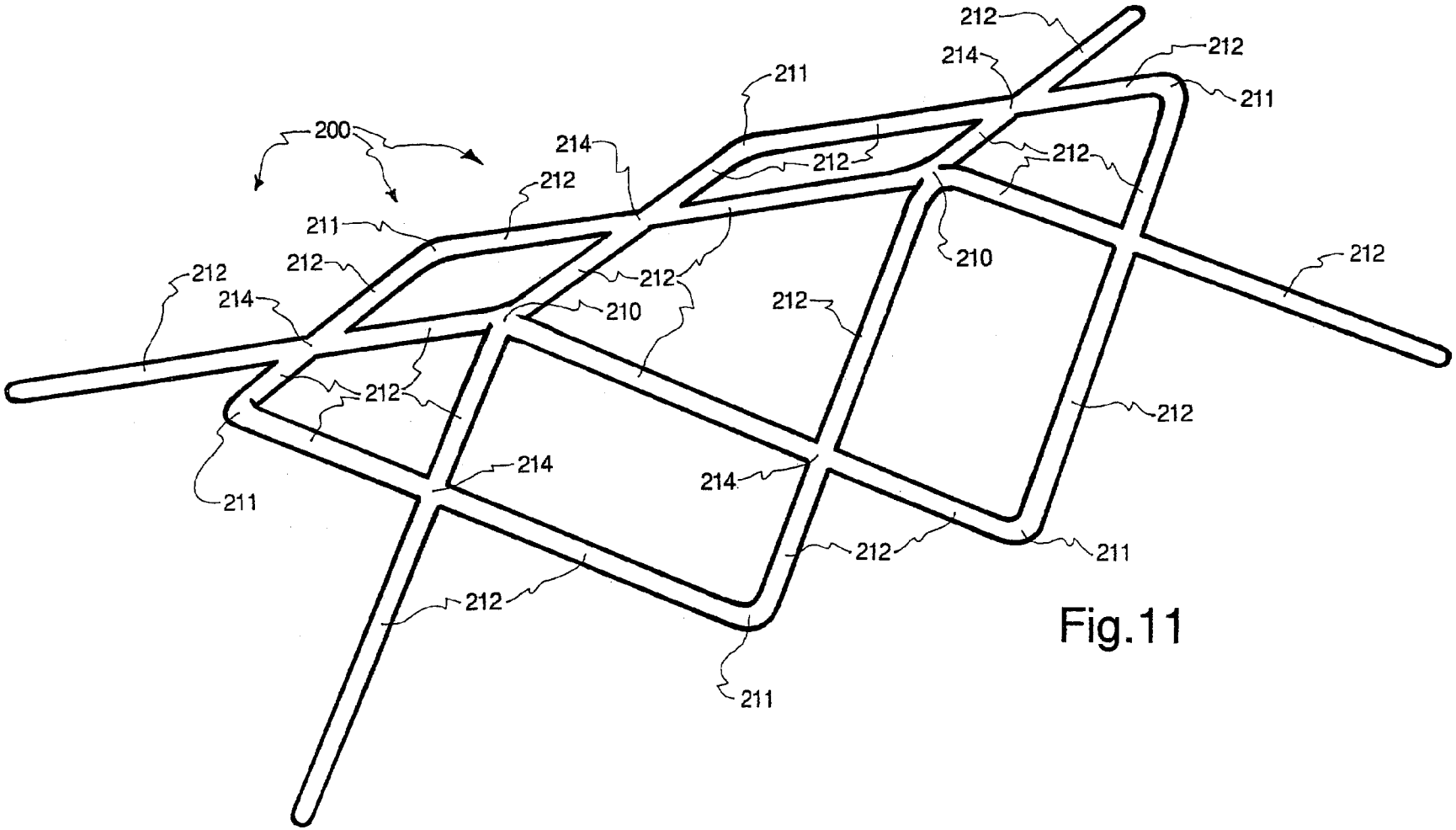
FIG. 11 is a perspective view of the frame of FIG. 10.
Figure 12:
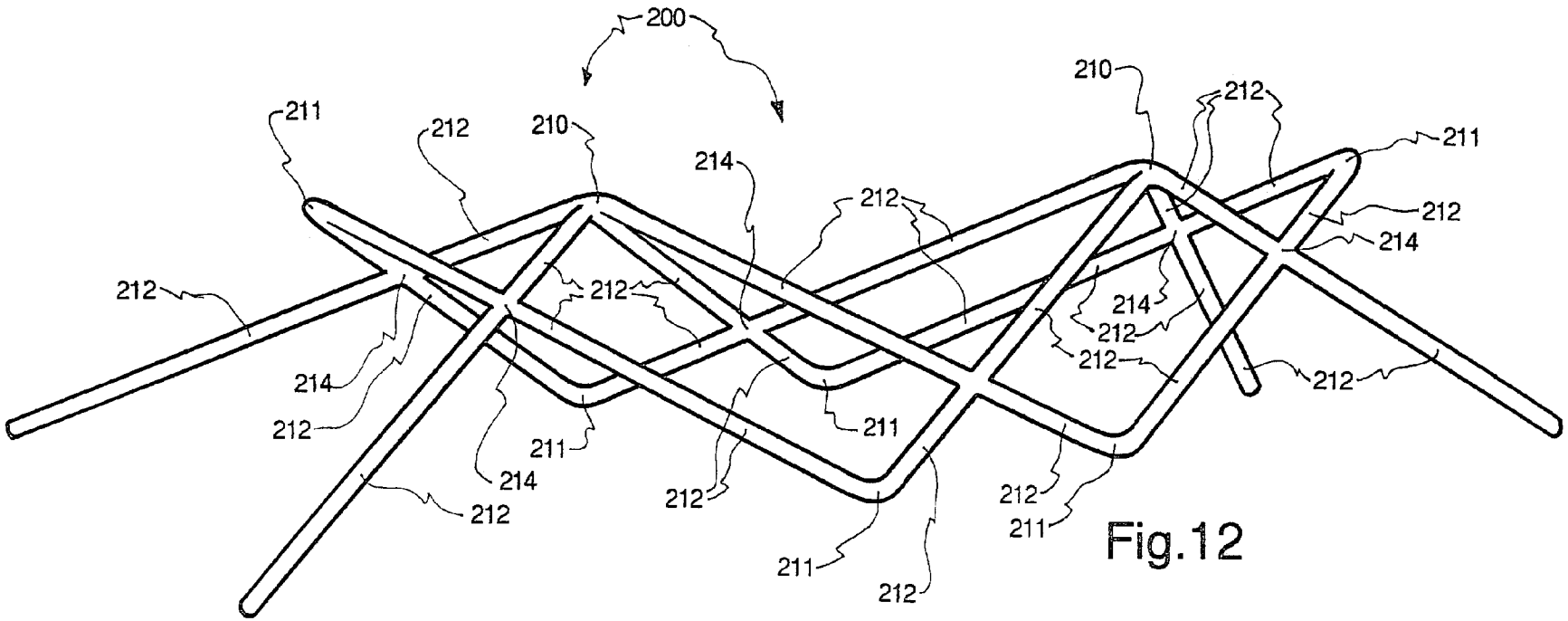
FIG. 12 is an additional perspective view of the frame of FIG. 10.

Reference is now made to FIGS. 10 through 12, which illustrate a further frame embodiment, generally designated 200, which embodies principles of the present invention. Frame 200 is similar to Frame 30, described above in conjunction with FIGS. 2A and 2B. Frame 200 comprises apexes 210 formed as the integral angular intersection of four slender members 212 and illustrated as extending in an upward direction. Frame 200 also comprises two slender member angular apexes 211. The lower set of apexes 211 are disposed in a common plane and the elevated apexes 210 and 211 are disposed in another, parallel plane. The narrow spacing between the two planes containing the apexes as explained above is so that the frame 200 can be utilized in flat panel construction, such as concrete floors to provide reinforcement for the concrete. In addition to the apexes 210 and 211, certain of the linear slender segments 200 intersect each other between the upper and lower apexes at spaced points of intersection 214. As best seen in FIGS. 11 and 12, the slender segments 212 comprise a plurality of zig zag members.

Figure 13:
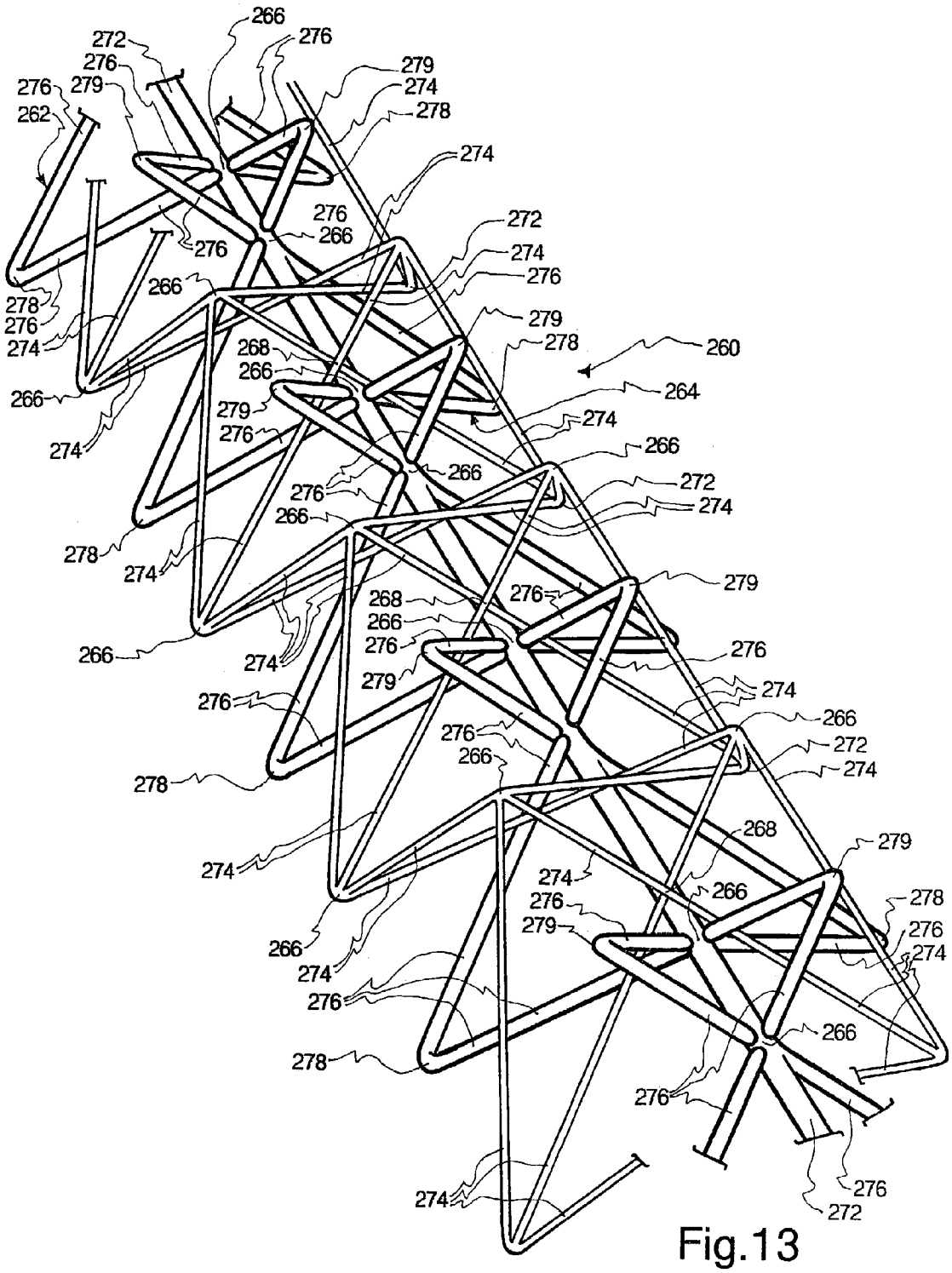
FIG. 13 is a fragmentary perspective of still another frame embodying principles of the present invention, which frame comprises primary and secondary support members.
Figure 14:
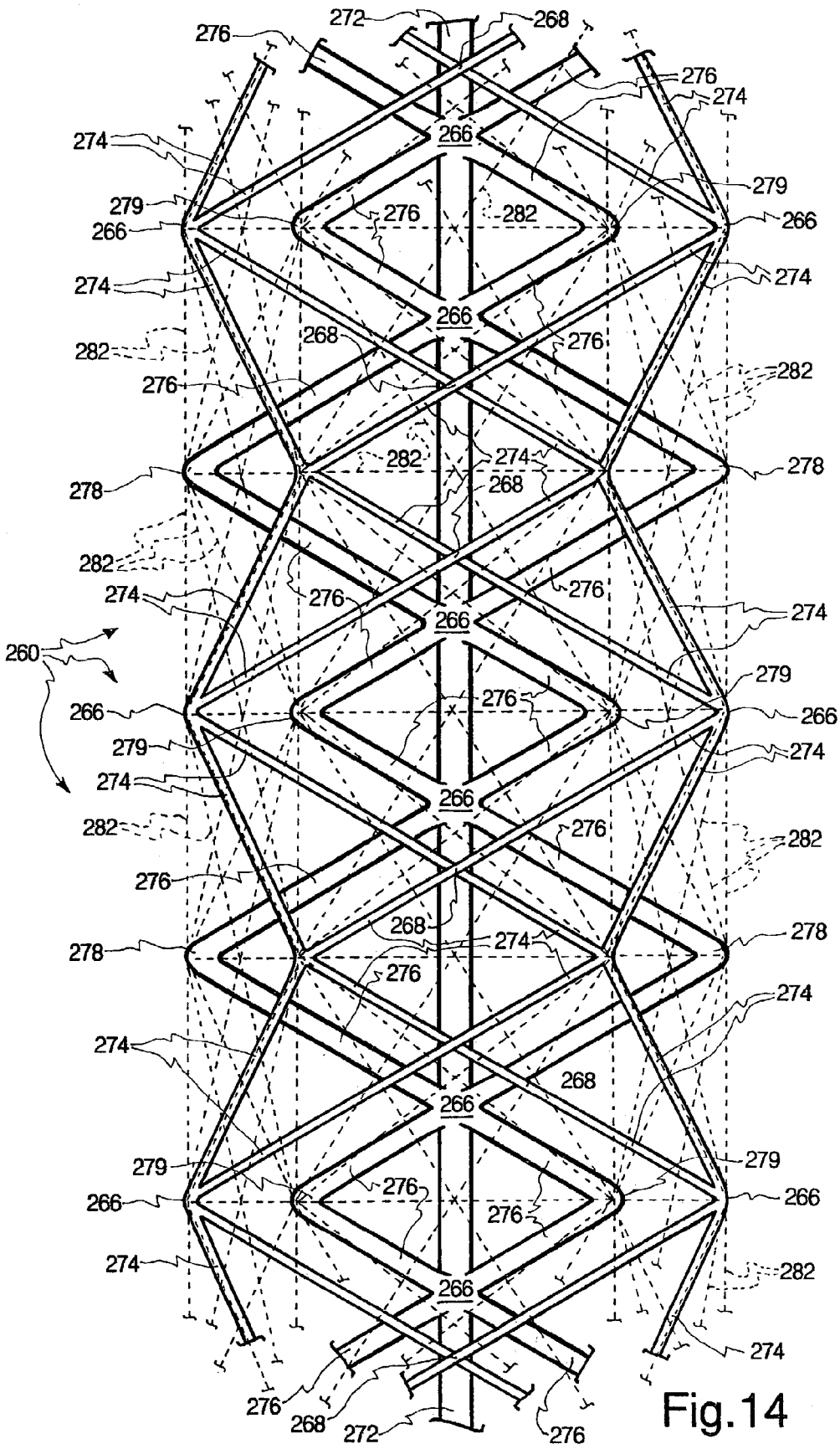
FIG. 14 is a top plan view of the frame of FIG. 13.
Figure 15:
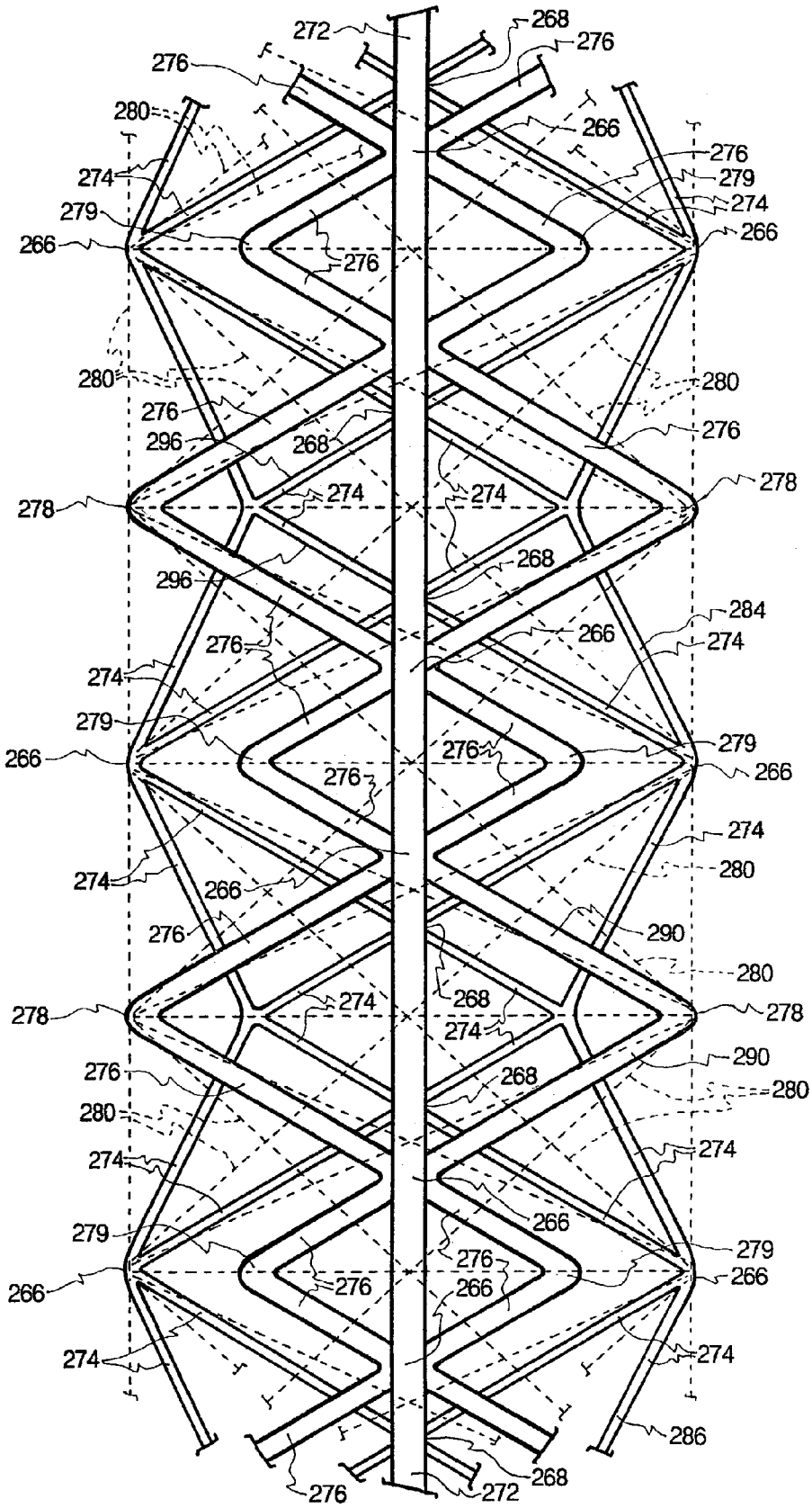
FIG. 15 is a bottom plan view of the frame of FIG. 13.

Reference is now made to FIGS. 13–15, which illustrates one more frame embodiment, generally designated 260. FIGS. 14 and 15, respectively, are slight modifications of the frame 260 illustrated in FIG. 13. The frame 260 can be utilized as illustrated as a beam or column and the pattern can be repeated axially and/or laterally to provide structural support not only for columns and beams but for other purposes such as flat concrete floors. Frame 260 comprises a central, axially extending linear member 272 and two major zig-zag members generally designated 262 and 264. The zig-zag members 262 and 264 cross at common points of intersection 266 where the central linear member 272 is also engaged. The manner in which the zig-zag numbers 262 and 264 intersect at sites 266 creates major, radially extending apexes 278 and minor axially extending apexes 279. Each apex 278 and 279 is formed by two angularly intersecting slender segments 276 of the zig-zag members. The apexes 278 are disposed in a first plane, while the apexes 279 are disposed in a second plane where, in the manner illustrated, the planes are parallel.

Frame 260 comprises secondary zig-zag members comprising slender segments 274, which zig-zag numbers are collectively comprised of overall axial and lateral dimensions substantially the same as the dimensions of the remainder of the frame 260. The secondary framework comprising reduced size slender linear members 274 form a series of four segment apexes 266.

A certain of the slender linear members 274 intersect with and integrally join each other at sites 268, which sites 268 are also integrated join to the central linear member 272.

The frame of FIG. 15 differs from the frame of FIG. 13 in that a few additional linear support members 280 are illustrated as having been added to the FIG. 13 frame. While support members 280 are illustrated as being single dotted lines, it is to be appreciated that each will be a suitable three dimensional structural member, of a desired size and cross section.

FIG. 14 comprises the frame 260 heretofore described in conjunction with FIG. 13 with a large number of additional structural members 282 than members 280 in the FIG. 15 frame. Both in FIGS. 15 and 14, the added structural members 280 and 282 extend between and integrate with apexes 278 and 279. As a consequence, greater strength is available when and as deemed appropriate by those skilled in the art of using frame embodiments of FIGS. of 14 and 15 when compared with the frame embodiment in FIG. 13.

The invention may be embodied in other specific forms without departing from the spirit of the central characteristics thereof. The present embodiments therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claim and desired to be secured by United States Letters Patent is:

1. A frame for providing structural support comprising at least first and second non-helical zig zag frame members each respectively comprising opposed sets of apexes and elongated segments between the opposite apexes, the zig zag members asymmetrically intersecting each other at spaced locations in a fixed relationship such that one zig zag member is immovable with respect to the other, the distances along the elongated segments from the intersection to one set of apexes being less than the distance along the elongated segments from the intersections to the opposite set of apexes.

2. A frame according to claim 1 wherein at least two zig zag frame members are respectively contained within diagonally intersecting planes.

3. A frame according to claim 1 wherein at least one of the zig zag frame members is not in a plane defined by another zig zag frame member.

4. A frame according to claim 1 wherein the opposed lesser distant apexes are respectively disposed in two intersecting planes and the opposed longer distance apexes are respectively disposed in two additional intersecting planes.

5. A frame according to claim 1 further comprising a linear member integrally merged at each integral intersection of the zig zag members.

6. A frame according to claim 1 wherein each apex is defined by two elongated segments only.

7. A frame according to claim 1 further comprising third and fourth zig zag members having an inverted orientation in respect to the first and second zig zag members such that four elongated segments integrally intersect at each apex and define four edges of a pyramid configuration adjacent each apex.

8. A frame according to claim 7 further comprising a linear member integrally merged at each integrated intersection of the four zig zag members.

9. A frame according to claim 7 wherein the sets of apexes are disposed in two spaced parallel planes.

10. A frame according to claim 1 wherein some of the apexes are formed by two elongated segments and others by four elongated segments.

11. A frame according to claim 10 wherein the frame extends through 360° when viewed in cross section.

12. A frame according to claim 1 wherein the frame comprises a cross section perpendicular to a longitudinal axis, the cross section having outermost points, and wherein a boundary defined by fitting the outermost points to a curve is non-circular.

13. A frame according to claim 1 further comprising a material encasing the frame, the material being selected from the group consisting of concrete, resin and composite.

14. A frame for providing structural support comprising at least four non-helical zig zag, lattice frame members collectively comprising sets of opposed apexes and elongated segments, elongated members of two of the zig zag members intersecting each other at spaced non-midpoint locations thereby permanently fixing the zig zag members such that each is immovable with respect to the other such that four elongated segments integrally intersect at each apex and define four edges of a pyramid configuration adjacent each apex.

15. A frame according to claim 14 where the frame extends through 360° when viewed in cross section.

16. A frame according to claim 14 further comprising at least one linear member merged at each integral intersection.

17. A method of assembling a structural framework comprising:

providing at least first and second non-helical zig zag frame members; joining the zig zag members such that the zig zag members define opposed sets of apexes with elongated segments between the opposite apexes; permanently fixing the zig zag members to each other so that they asymmetrically integrally intersect each other at spaced locations, whereby the distances along each elongated segment from each intersection location to the two adjacent apexes are unequal.

18. A method according to claim 17 further comprising orienting the at least two zig zag frame members within diagonally intersecting planes.

19. A method according to claim 17 further comprising orienting the opposed lesser distant apexes in two intersecting planes and the opposed longer distance apexes in two additional intersecting planes.

20. A method according to claim 17 further comprising integrally merging a linear member at each integral intersection between the two zig zag members.

21. A method according to claim 17 wherein each apex is defined exclusively by two elongated segments.

22. A method according to claim 17 further comprising providing third and fourth zig zag members having an inverted orientation in respect to the first and second zig zag members such that four elongated segments integrally intersect at each apex and define four edges of a pyramid configuration adjacent each apex.

23. A method according to claim 22 further comprising integrally merging a linear member at each integrated intersection between the four zig zag members.

24. A method according to claim 22 wherein the sets of apexes are disposed in two spaced parallel planes.

25. A method according to claim 17 comprising forming some of the apexes by two elongated segments and others by four elongated segments.

26. A method according to claim 25 wherein the frame extends through 360° when viewed in cross section.

27. A method according to claim 17 wherein the frame comprises a cross section perpendicular to a longitudinal axis, the cross section having outermost points, and a boundary defined by fitting the outermost points to a curve is non-circular.

28. A method according to claim 17 further comprising encasing the frame with material being selected from the group consisting of concrete, resin and composite.

29. A method for providing structural support comprising joining at least three non-helical zig zag frame members to collectively define sets of opposed apexes and elongated segments and combining the elongated members of two of the zig zag members such that the zig zag members intersect each other at spaced non-midpoint locations thereby permanently fixing two of the zig zag members to each other such that the zig zag members are one integral piece.

30. A method according to claim 29 wherein the frame extends through 360° when viewed in cross section.

31. A method according to claim 29, wherein at least one linear member is merged at each integral intersection.

* * * * *